US010526158B2

(12) United States Patent
Wolfram

(10) Patent No.: US 10,526,158 B2
(45) Date of Patent: Jan. 7, 2020

(54) METHOD FOR FORMING A HOSE COMPRISING A FLAT WEB MATERIAL AS WELL AS A HOSE FORMATION DEVICE AND A SYSTEM FOR PRODUCING BAGS

(71) Applicant: WINDMOELLER & HOELSCHER KG, Lengerich (DE)

(72) Inventor: Uwe Wolfram, Kogel (DE)

(73) Assignee: WINDMOELLER & HOELSCHER KG, Lengerich (DE)

( * ) Notice: Subject to any disclaimer, the term of this patent is extended or adjusted under 35 U.S.C. 154(b) by 685 days.

(21) Appl. No.: 15/028,629

(22) PCT Filed: Oct. 10, 2014

(86) PCT No.: PCT/EP2014/071726
§ 371 (c)(1),
(2) Date: Apr. 11, 2016

(87) PCT Pub. No.: WO2015/052309
PCT Pub. Date: Apr. 16, 2015

(65) Prior Publication Data

US 2016/0250818 A1 Sep. 1, 2016

(30) Foreign Application Priority Data

Oct. 11, 2013 (DE) ..... 10 2013 220 512

(51) Int. Cl.
*B65H 35/04* (2006.01)
*B65H 23/02* (2006.01)
(Continued)

(52) U.S. Cl.
CPC ..... *B65H 35/04* (2013.01); *B31B 70/00* (2017.08); *B65H 23/02* (2013.01); *B31B 70/266* (2017.08);
(Continued)

(58) Field of Classification Search
CPC ..... B31B 19/36; B31B 70/00; B65H 23/02; B65H 35/04
See application file for complete search history.

(56) References Cited

U.S. PATENT DOCUMENTS 3,185,044 A * 5/1965 Ahlbrandt ..... B31B 70/00 414/431
4,871,347 A 10/1989 Brinkmeier
(Continued)

FOREIGN PATENT DOCUMENTS

AT 365515 1/1982
DE 221293 9/1973
(Continued)

*Primary Examiner* — Michelle Lopez
*Assistant Examiner* — Chinyere J Rushing-Tucker
(74) *Attorney, Agent, or Firm* — Jacobson Holman, PLLC.

(57) ABSTRACT

A method of forming a hose from a flat web material includes supplying the flat web material via a feeding device, folding the edges of the flat web material with at least one hose formation tool, with the edge sections subsequently overlapping, and connecting to each other parts of the overlapping edge sections, A target position of at least one edge is determined after the edges have been folded over, with the actual position of at least one edge being determined by a measuring device. In the event of a deviation of the actual position from the target position, the hose formation tool is moved, via an actuator, at least perpendicular relative to the direction of transportation of the flat web material.

17 Claims, 2 Drawing Sheets

(51) Int. Cl.

| | |
|---|---|
| ***B31B 70/00*** | (2017.01) |
| *B31B 70/36* | (2017.01) |
| *B31B 70/64* | (2017.01) |
| *B31B 155/00* | (2017.01) |
| *B31B 160/20* | (2017.01) |
| *B31B 70/26* | (2017.01) |

(52) U.S. Cl.
CPC ..... *B31B 70/36* (2017.08); *B31B 70/64* (2017.08); *B31B 2155/00* (2017.08); *B31B 2155/0012* (2017.08); *B31B 2160/20* (2017.08); *B65H 2301/41487* (2013.01); *B65H 2701/191* (2013.01)

(56) References Cited

U.S. PATENT DOCUMENTS 6,149,565 A * 11/2000 Meyer ..... B31B 70/00 493/11
6,254,521 B1 * 7/2001 Pansier ..... B65D 31/08 493/194
2003/0144120 A1 * 7/2003 Terranova ..... B31B 70/00 493/13
2015/0141228 A1 * 5/2015 Schalck ..... B31B 29/00 493/241

FOREIGN PATENT DOCUMENTS

| | | |
|---|---|---|
| DE | 3640219 | 6/2011 |
| DE | 102009056078 | 6/2011 |
| DE | 102011076922 | 12/2012 |
| DE | 102012101932 | 9/2013 |
| EP | 1195322 | 4/2002 |
| EP | 1228857 | 4/2005 |
| GB | 1373203 | 11/1974 |
| GB | 1592905 | 7/1981 |
| JP | H08337219 | 12/1996 |

* cited by examiner

METHOD FOR FORMING A HOSE COMPRISING A FLAT WEB MATERIAL AS WELL AS A HOSE FORMATION DEVICE AND A SYSTEM FOR PRODUCING BAGS

BACKGROUND OF THE INVENTION

1. Field of the Invention

The invention relates to a method for forming a hose made from a flat web material according to the preamble of claim 1 as well as a hose formation device according to the preamble of claim 9, Furthermore, the invention relates to a system for producing bags according to the preamble of claim 17.

2. Description of Related Art

Those sections are a semi-finished product during the production of bags and sacks, which frequently are separated from a hose, thus for example cut off or torn off. Such hoses are produced in a method and a device for producing a hose from a flat web material by this flat web being supplied via feeding devices, such as deflection rolls. The flat web material comprises here an area, which is limited by the lateral edges and/or borders. Then the borders, which are also called lateral edges, are folded inwardly by hose forming tools, namely such that the edge sections overlap each other. Parts of the overlapping edge sections are connected to each other. This can occur for example by inserting an adhesive substance (hot glue, cold bond, plastic melt) between the individual edge sections overlapping each other. A connection can also be made by contact welding, hot air sealing, or even by way of sewing. The actual hose is formed thereby. Tools for hose formation include for example guiding sheets and guiding rods for folding the edges and other guiding devices.

Folding, holding, and pressing tools may also be mentioned, here. Additional hose forming tools may include side pleating tools by which during the actual hose formation in additional gusseted folds may be embodied in the hose in order to allow later producing lateral fold bags or sacs. All of these tools are generally arranged fixed, however they may be displaced for adjusting the hose production. Manually operated fastening elements, such a hand operated screws are common. Once the hose formation device has been adjusted for the production, in general no further changes are necessary. Now the hose is formed in a continuous process.

However, it may also occur that the flat web material used is not sufficiently homogenous over its entire width and/or its entire length. Due to the fact that in the hose formation device rather strong lateral forces may act upon the flat web material, here uncontrolled and thus undesired shifting of the material can occur perpendicular in reference to its direction of transportation, which leads to differently wide folds. This way, a deviation is given from the target geometry of the hose, which is expressed for example in that the seam of the hose is not located at its target position, but shifted perpendicularly in reference to the direction of extension of the hose.

This is not only ugly when it is important for the prints to be correctly positioned with regards to the hose edges. It is particularly problematic if prior to the hose formation the flat web material was processed for a later production of bags or sacks, however these processing positions were incorrectly arranged with regards to their location in reference to the edges of the hose. The later sacks or bags may then be flawed.

SUMMARY OF THE INVENTION

The objective of the present invention is therefore to suggest a method and a device by which the above-described disadvantages can be avoided.

According to the invention, this objective is attained in the features described herein. Based on the prior art described at the outset the objective is attained in that the target position of an edge is determined, which shall result after the folding of the edges. This target position can be entered into a control device by entering a numeric value, which defines the absolute position or a relative position in reference to a stationary part. The clamping of the flat web material in a hose formation device with correct positioning can also be understood as determining the target value. This clamping occurs usually when the device is stationary, thus prior to the start of production.

According to the invention, the actual position of the edge is determined with a measuring device. If the target position and the actual position deviate from each other the hose formation tool or the hose formation tools is/are displaced perpendicular in reference the direction of transportation of the flat web material. The flat web material is therefore not displaced prior to the actual hose formation device, rather any non-stationary conditions occurring in the actual hose formation process are compensated such that the hose formation tool is made to follow the actual position of the edge. When now simultaneously the measuring device is also entrained, after the correction has occurred the actual position becomes the new target position. This process can repeat several times during order processing. In this case, any entering of the absolute target position is not required.

This procedure achieves that, with the displacement of the hose formation tool, the relative position of the lateral edges of the later hose, are also displaced laterally with the edge or edges, to the extent they have laterally shifted. Thus, thereafter the hose will always show the same position of the seam in reference to its lateral edges over its entire length, except for minor deviations. Prints and processing positions will now be found repeatedly at the same points laterally in reference to the longitudinal extension of the hose.

The invention offers particular advantages in connection with the production of hoses made from a flat web material, which comprises a plastic web. This plastic web frequently comprises a polyolefin material, for example polypropylene, and is produced such that stretched tapes, frequently showing a width from 2 to 5, mm are processed from this material into a round or flat web. A round web may initially be flattened and individualized by sewing or cutting the edges to form a flat web material. A unilateral sewing or cutting open and a folding of the two layers is generally possible in order to yield a flat web material. This flat web material is frequently provided with a coating. This coating is advantageously made from plastic, showing a lower melting temperature than the web material. This way it is possible for the production of sacks or bags to connect parts of the hose sections to each other permanently via hot air sealing without here excessively heating the web material in the sealing process, because the web material would then lose its strength.

The coating of the web material additionally provides the advantage that it can be printed easily and with high quality results and that it serves as a moisture barrier. Web material per se offers the advantage that compared to a standard plastic film it shows relatively high strength with low quantities of material used.

However, it is very expensive to homogenously produce the web and particularly the coating such that for a hose formation device according to prior art could produce hoses with satisfactory quality. The reason therefore is the fact that for example the web frequently shows a "twist" in the circumferential direction (longitudinal tapes are tipped over against the direction of transportation) and that primarily the coating cannot be produced with a constant thickness over the width of the flat web material. The lateral forces occurring in the direction of hose formation already described above therefore have particularly negative effects upon the coated web material.

With the hose formation device according to the invention and with the method according to the invention, advantageously performed with a flat web material made from coated webs, here web hoses can be produced which avoid the above-stated disadvantages and which are excellently suited for the production of bags or sacks.

It is further advantageous when the flat web material is provided with perforation cuts before it is formed into a hose. Such perforation cuts can be generated with a cutting roll, which acts against a counter roll guiding the flat web material. Touchless and thus low-wear methods and devices are advantageous, such as a laser beam arrangement. The invention offers advantages particularly when such perforation cuts are arranged in a staggered fashion, i.e. arranged at different positions seen in the longitudinal direction. Such staggered perforation cuts are frequently inserted in the flat web material in order to allow generating stable and particularly tight bottoms of sacks or bags at a later time. A production method for these bags is shown in EP 1 228 857. The description of the staggered cuts discussed there is hereby included in the content of the invention disclosed in the patent application. It is clearly discernible that the staggered cut must correspond with the folding edges of the hose, i.e. the leaps between the individual sections of the cut should rest on the edges and/or borders of the hose in order to allow producing a proper sack. However, it occurs in prior art that by the "rolling" of the flat web material during the hose formation in the lateral direction the stacked perforation is displaced over the later edges, i.e. the staggered perforation is located in the lateral direction offset in reference to the edges of the hose. Advantageously, the present invention is therefore preferably combined with perforation cuts, particularly staggered cuts.

In an advantageous embodiment of the invention it is provided that at least one hose formation tool is arranged on a frame and that this frame is mobile. A motion occurs here when a deviation is detected between the target position and the actual position.

Advantageously the frame carries all hose formation tools and also a device for connecting edge sections overlapping in the hose formation process. In order to shift the frame then only a single displacement drive is required, for example an electric motor, which acts upon a spindle-spindle nut combination. The number and assembly position of the hose formation tools can also be varied largely in this process.

An advantageous embodiment of the invention additionally provides for the use of an ultrasound sensor or an electro-optic sensor as the measuring device. These sensors generally comprise a transmitter, which for example emits ultrasound waves or electro-optic radiation. Opposite in reference to this transmitter, a planar receiver is arranged, which provides a value depending on the intensity of the waves or radiation received, for example a current value or a voltage. If now a part of the receiver area is covered the value proportionally reduces in reference to the size of the part of the receiver area covered. The transmitter and the receiver are arranged stationary in reference to each other. At least one edge of the flat web material is here guided between the transmitter and the receiver. In the basic setting of the method according to the invention the sensor is positioned before to the actual start of production of the hose, thus preferably at standstill, the transceiver unit is positioned such that if possible half of the receiver area is covered so that the change of the value can be detected in both directions. This means, an increase of the value is observed when the edge and/or the edge area of the flat web material release a greater sensor area and a reduction of the value when the edge of the flat web material covers a greater area. The value measured is therefore a function of said deviation. The target position of the flat web material is now determined either by it covering for example a previously predetermined portion of the receiver area or that, after the adjustment of the flat web material, the covered portion of the receiver area is determined and reported to the control device.

If now during the ongoing operation a deviation results from the target position, thus a deviation from the set value, simultaneously to the displacement of at least one hose formation tool the transceiver unit, thus the sensor, can be displaced, so that subsequently the previously set portion of the receiver area is covered once again. This is achieved in a particularly advantageous fashion by an arrangement of the sensor on the frame when the frame is displaced in order to move the hose formation tool. During the formation of a hose made from a flat web material, in which a staggered cut and/or a staggered perforation is inserted, it is advantageous to perform the correction when the actual position deviates from the target position by 2 mm. In case of such or a greater deviation otherwise the sealing of the later sacks or bags would no longer be ensured.

The actual position of the edge is preferably arranged at a position inside the hose formation device, seen in the direction of transportation of the flat web material, in which the edge areas of the flat web material have already been made to overlap and are preferably not yet connected to each other. In other words, at this position the formation of the hose is almost concluded, however the lasting connection of the edge sections remains to be done. Particularly at this position, the effects of lateral forces within the hose formation process can be determined with utmost security. Additionally, the adjustment is easy at this point, particularly since here only few adjusting means are required.

The above-stated objective is also attained in a hose formation device showing the features described herein. Accordingly, a hose formation device for forming a hose made from a flat web material, which at least comprises a feeding device for supplying a flat web, at least one hose formation tool for folding the lateral edges of the flat web, with subsequently the edges overlapping, and at least one device for connecting parts of the overlapping edges, is further developed according to the invention such that a device is provided by which the target layer of at least one edge can be fixed after the folding of the edges, that a measuring device for determining the actual layer of at least one edge is provided, and that an adjusting device for moving the hose formation tools is provided at least laterally in reference to the direction of transportation of the flat web material in case of a deviation of the actual position from the target position.

The motion occurs here in reference to the flat web material present in the feed and/or in reference to at least one feeding device, which guides the flat web material.

The features described in the context with the method according to the invention can also be components of a device according to the invention such that they can also be connected to a device according to the invention. Additionally, features of a method according to the invention disclosed in the context with the device according to the invention may also be relevant, so that reference thereto is also possible.

The objective of the invention further relates to a system for producing sacks or bags as described herein. This objective attains the task that sacks or bags may be of reduced quality when the hose shifts laterally inside the hose formation device and thus the bottoms of the bag or sacks cannot be formed such that they meet the requirements.

A production device for the bottom, which may be a component of the system according to the invention, is described in DE 10 2009 056 078 A1. This disclosure is hereby included as a component of the present disclosure.

The just mentioned objective is attained such that a hose formation device as described above and further herein is provided as a hose formation device.

Additional exemplary embodiments of the invention are discernible from the present description and the claims.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
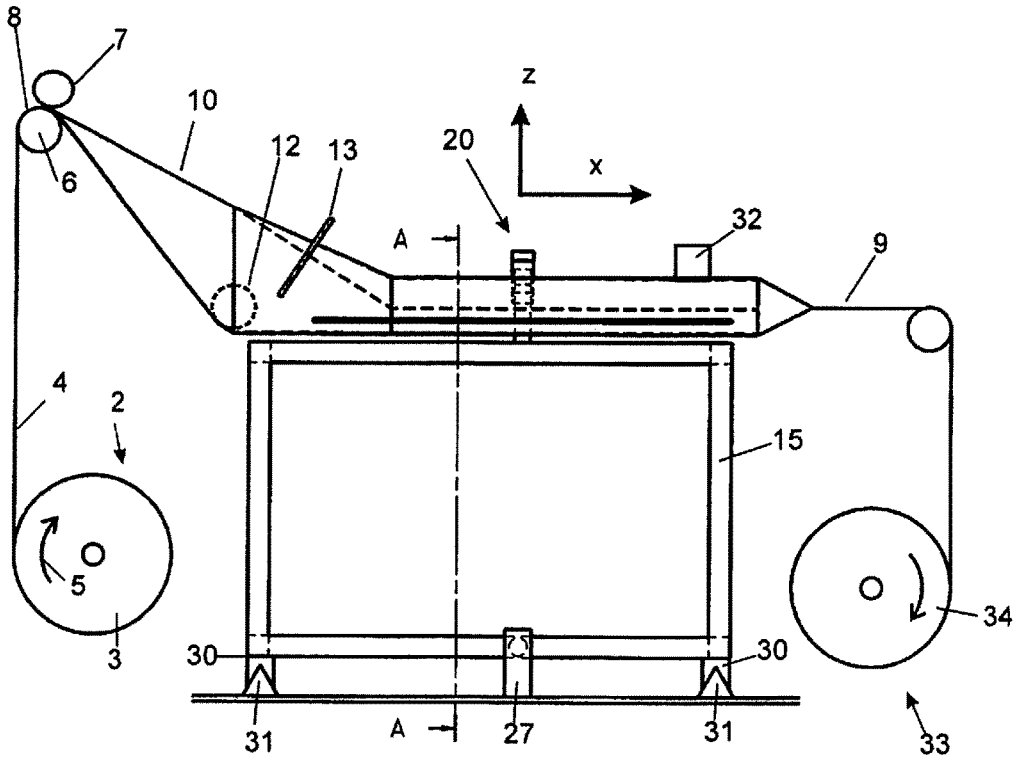
FIG. 1 a side view of a hose formation device according to the invention

FIG. 1 shows a side view of a hose formation device 1 according to the invention. The hose machine comprising the hose formation device first comprises an unwinding device 2, in which a coil 3 of a flat web material 4 rotates in the direction of the arrow 5. The flat web material 4 is guided via a deflection roll 6, which represents a simple example of a feeding device of the flat web material 4 to the hose formation device 1.

The deflection roll 6 is shown in this exemplary embodiment as a counter roll for the cutting roll 7, by which perforations can be inserted in the flat web material. The cutting roll 7 carries one or more perforating knives 8. The functions of the deflection roll 6, thus "deflecting" and "providing counter pressure in the perforation process", are here only combined for reasons of better visibility, however in practice they are usually separated.

The actual hose formation process begins already in the area between the deflection roll 6 and the hose formation device 1 by the edges 10 and 11 being guided upwards, thus in the direction z. Here, for example the compression roll 12, which holds the central part of the flat web material 4 at a fixed position in reference to the z-axis, and the guiding sheet 13 which from the outside applies lateral guiding forces for the flat web material are supportive. The compression roll 12 and the guide sheets 13 are examples for a plurality of potential hose formation tools, which may be used to provide the future hoses with the desired appearance. Additional examples for hose formation tools have already been provided in the general description of the invention.

All of these hose formation tools are arranged at a frame 15, allowing the hose formation tools to be displaced in reference to the frame for adjustment and/or for preparing the production via suitable adjusting and fastening devices and to be fastened subsequently.

It is easily discernible at the example of the guide sheets 13 that lateral forces are applied to the flat web material which may lead to a displacement of the hose in the z-direction and/or the y-direction.

Figure 3:
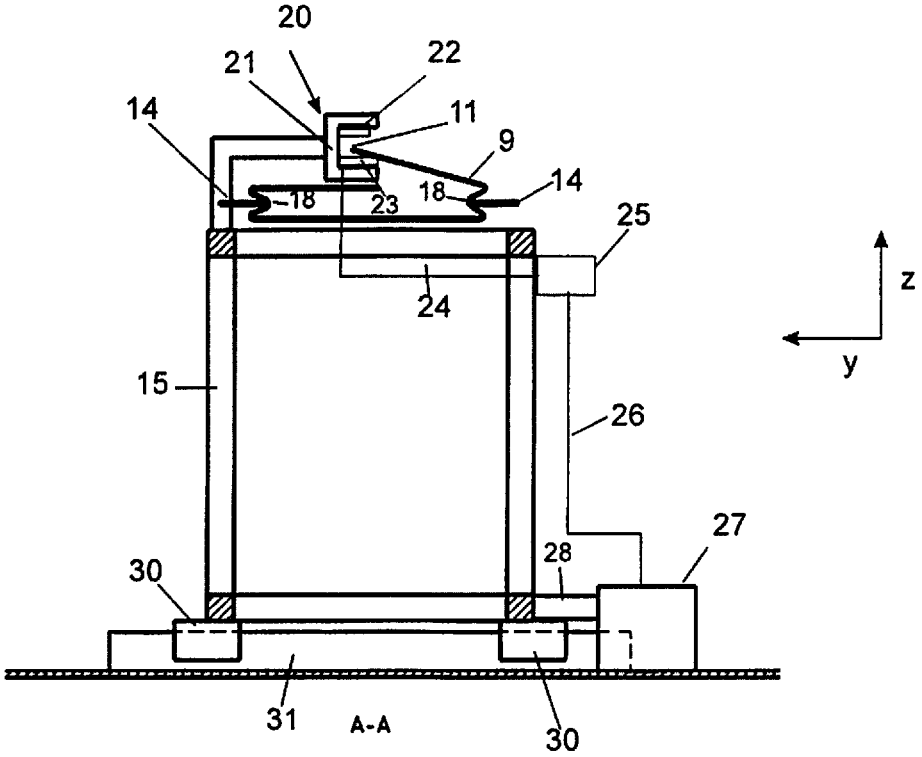
FIG. 3 a view of the section A-A in FIG. 1.

Additional hose formation tools are discernible in FIG. 3, which can be called lateral fold inserts 14. The lateral folds 18 that can be generated this way are preferably used for the production of certain bags or sacks because after their filling frequently almost a cuboid is formed, which offers advantages during storage and transportation. Particularly hoses with lateral edges can be produced in a particularly advantageous fashion on a device according to the invention using the method according to the invention because it particularly comprises hoses with lateral folds, primarily when they comprise staggered perforations, with the correct position of the edges after the hose formation being crucial, here.

Figure 2:
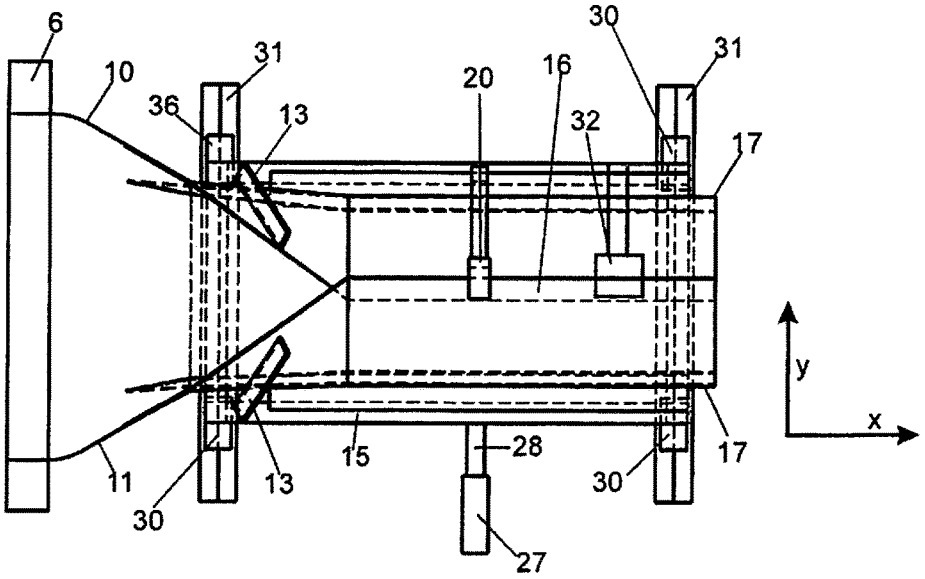
FIG. 2 a top view of a hose formation device according to the invention

In the further progression of the hose formation process the edge areas of the flat web material are placed over top of each other such that already the cross-sectional contour represents a hose, which is still open in the longitudinal direction. This is clearly discernible in FIG. 3. The overlapping area 16 of the edge areas and/or the edges of the flat web material 4 is discernible in FIG. 2. The exterior folding edges of the hose can also be called lateral or exterior edges 17.

In the further progression of the hose transportation in the direction z the sensor unit 20 follows, which is clearly discernible in FIG. 3. It includes a U-shaped profile 21 fastened at the frame 15, which carries the transmitter 22 and the receiver 23 of the sensor. The hose formation tools are arranged and embodied such that the edge 11 extends between the transmitter 22 and the receiver 23.

A change in position of the edge 11 in the y-direction can therefore be detected by the sensor, with the sensor being implemented such that it can determine the extent of the change in position. The receiver transmits respective values or signals via a data line 24 to the control unit 25. Said control unit converts this information into control information which is sent via the control line 26 to the actuator 27.

The actuator drive is arranged fixed, for example by way of a screw connection, to the floor of the facility, and via displacement elements it causes a shift of the frame in the y-direction. The actuator may for example be a rotating electric motor, which acts via transmission elements 28, such as a spindle-spindle nut arrangement or a rack and pinion arrangement, upon the frame 15. A linear drive, for example a linear electric motor, is possible and would also be operational without transmission elements.

The frame 15 rests on the sled 30, which in turn rest on the guide rails 31 and are displaceable along thereof. The contact between the sled and the guide rails can be formed here by sliding or roll elements.

For the completion of the hose 9, here another permanent connection of the edge areas of the already deformed flat web material 4 is necessary, which already overlap in the overlapping area 16. For this purpose an extrusion device 32 is provided, by which molten plastic can be applied in the overlapping area 16 between the edge sections. With a compression roll, following in the x-direction but not shown here, the overlapping area is then compressed such that after the setting of the plastic here a solid connection results. However, many other types of connections are also possible.

The now finished hose 9 is generally deformed in the winding device 33 into a hose coil 34 (see FIG. 1), which then can be fed to a bagging machine.

However it is also possible that a further processing machine directly follows the hose machine, without first requiring hose coils to be formed.

The invention being thus described, it will be apparent that the same may be varied in many ways. Such variations are not to be regarded as a departure from the spirit and scope of the invention, and all such modifications as would be recognized by one skilled, in the art are intended to be included within the scope of the following claims.

LIST OF REFERENCE CHARACTERS

| | |
|---|---|
| 1 | Hose formation device |
| 2 | Winding device 2 |
| 3 | Coil |
| 4 | Flat web material |
| 5 | Arrow (direction of rotation of the coil 3) |
| 6 | Deflecting roll |
| 7 | Cutting roll |
| 8 | Perforation roll |
| 9 | Hose |
| 10 | Edge |
| 11 | Edge |
| 12 | Compression roll |
| 13 | Guide sheet |
| 14 | Lateral fold insert |
| 15 | Frame |
| 16 | Overlapping area |
| 17 | Lateral or exterior edges |
| 18 | Lateral folds |
| 19 | |
| 20 | Sensor unit |
| 21 | U-shaped profile |
| 22 | Transmitter |
| 23 | Receiver |
| 24 | Data line |
| 25 | Control unit |
| 26 | Control unit |
| 27 | Actuator |
| 28 | Transmission elements |
| 29 | |
| 30 | Sled |
| 31 | Guide rail |
| 32 | Extrusion device |
| 33 | Winding device |
| 34 | Hose coil |

What is claimed is:

1. A method of forming a hose from a flat web material, said method comprising:

supplying the flat web material via feeding devices;

folding over edges of the flat web material with at least one hose formation tool, with edge areas subsequently overlapping;

connecting parts of overlapping sections with one another;

determining a target position of at least one of the edges after the folding over of the edges;

determining an actual position of the at least one of the edges with a measuring device; and in an event of a deviation of the actual position from the target position, to make a correction, moving the hose formation tool via an actuator at least perpendicular relative to a direction of transportation of the flat web material, the measuring device being moved simultaneously with the hose formation tool, such that, after the correction has been made, the actual position becomes a new target position.

2. The method according to claim 1, wherein the flat web material is a plastic web.

3. The method according to claim 2, wherein the plastic web is a coated plastic web.

4. The method according to claim 1, further comprising a step of providing the flat web material with perforation cuts prior to the hose formation.

5. The method according to claim 1, wherein the hose formation tool is arranged on a frame, and the frame is moved.

6. The method according to claim 1, wherein the measuring device is an ultrasound sensor or an electro-optic sensor.

7. The method according to claim 1, wherein the actual position of the edge is determined after the edges of the flat web material have been brought into the overlapped position.

8. The method according to claim 1, wherein the actual position of the edge is determined before the overlapping edges are connected to each other.

9. A hose formation device for forming a hose from a flat web material, said device comprising:

at least one feeding device for supplying a flat web material;

at least one hose formation tool for folding lateral edges of the flat web material, such that edge areas thereof are overlapping;

at least one device for connecting parts of overlapping edges;

a device for fixing a target position of at least one of the edges after the edges are folded over;

a measuring device for determining an actual position of the at least one of the edges; and in an event of a deviation of the actual position from the target position, to make a correction, an actuator for moving the hose formation tool at least perpendicular relative to a direction of transportation of the flat web material, the measuring device being moved simultaneously with the hose formation tool, such that, after the correction has been made, the actual position becomes a new target position.

10. The hose formation device according to claim 9, wherein the feeding device includes a device for inserting perforation cuts into the flat web material.

11. The hose formation device according to claim 9, wherein the hose formation tool is arranged on a frame, and the frame is arranged so as to be displaceable.

12. The hose formation device in accordance with claim 11, further comprising guide devices which extend substantially perpendicular relative to the direction of transportation of the flat web material, and with the frame including sleds which are displaceable on the guide devices.

13. The hose formation device in accordance with claim 9, wherein the measuring device is an ultrasound sensor or an electro-optic sensor.

14. The hose formation device according to claim 9, wherein the measuring device is arranged, relative to the direction of transportation of the flat web material, downstream of the at least one hose formation tool.

15. The hose formation device according to claim 9, wherein the measuring device, relative to the direction of transportation of the flat web material, is arranged upstream of the device for connecting the parts of the overlapping edges.

16. The hose formation device according to claim 9, further comprising a control device, to which the actual position of the at least one edge can be transmitted by the measuring device, with which the actual position can be compared with the target position, and with which control signals can be transmitted to the actuator.

17. A system for making bags, said system comprising:

a hose formation device for forming a hose from a flat web material, the hose formation device including at least one feeding device for supplying the flat web material, at least one hose, formation tool for folding lateral edges of the flat web material, such that edge areas thereof are overlapping, at least one device for connecting parts of overlapping edges, a device for fixing a target position of at least one of the edges after the edges are folded over, a measuring device for determining an actual position of the at least one of the edges, and in an event of a deviation of the actual position from the target position, to make a correction, an actuator for moving the hose formation tool at least perpendicular relative to a direction of transportation of the flat web material, the measuring device being moved simultaneously with the hose formation tool, and, after the correction has been made, the actual position becoming a new target position;

a separating device for separating the hose into hose sections; and a bottom production device for providing a bottom at at least one end of the hose sections.

* * * * *